US006898818B2

(12) United States Patent
Lin

(10) Patent No.: US 6,898,818 B2
(45) Date of Patent: May 31, 2005

(54) DUSTING BRUSH

(76) Inventor: Chia-Hao Lin, No. 146, Sec. 1, Chung-shan Rd., Chung-Chuan, Hua Tan, Chang-Hua (TW)

( * ) Notice: Subject to any disclaimer, the term of this patent is extended or adjusted under 35 U.S.C. 154(b) by 7 days.

(21) Appl. No.: 10/657,264

(22) Filed: Sep. 9, 2003

(65) Prior Publication Data

US 2005/0050664 A1 Mar. 10, 2005

Related U.S. Application Data

(63) Continuation-in-part of application No. 10/193,301, filed on Jul. 12, 2002, now abandoned.

(51) Int. Cl.[7] ..... A46B 7/00; A46B 9/08
(52) U.S. Cl. ..... 15/184
(58) Field of Search ..... 15/184

(56) References Cited

U.S. PATENT DOCUMENTS 6,226,828 B1 * 5/2001 Lin ..... 15/184
6,725,496 B2 * 4/2004 Chang ..... 15/184
6,742,214 B2 * 6/2004 Lee ..... 15/169

* cited by examiner

*Primary Examiner*—Randall Chin
(74) *Attorney, Agent, or Firm*—Charles E. Baxley

(57) ABSTRACT

A dusting brush includes a brush holder, a sliding sleeve slidably mounted on the brush holder, two symmetrical ornament shells mounted on the sliding sleeve to move therewith, and a plurality of bristles mounted on the brush holder. Thus, the dusting brush can be operated easily and conveniently, thereby facilitating the user operating the dusting brush. In addition, the bristles are fully hidden in the sliding sleeve when not in use, thereby enhancing the aesthetic quality of the dusting brush.

9 Claims, 8 Drawing Sheets

DUSTING BRUSH

CROSS-REFERENCES TO RELATED APPLICATIONS

The present invention is a continuation-in-part application of the U.S. Ser. No. 10/193,301, filed on Jul. 12, 2002, now abandoned.

BACKGROUND OF THE INVENTION

1. Field of the Invention

The present invention relates to a dusting brush, and more particularly to a dusting brush that can be operated easily and conveniently.

2. Description of the Related Art

A conventional dusting brush in accordance with the prior art shown in FIG. 8 comprises a handle 7, and a plurality of bristles 6 mounted on the top of the handle 7. Thus, the conventional dusting brush can be used to clean and remove the dust, dirt or the like. However, the bristles 6 protrude outward from the handle 7 when not in use, thereby decreasing the aesthetic quality of the conventional dusting brush.

The closest prior art of which the applicant is aware is disclosed in his U.S. Pat. No. 6,226,828-B1, filed on Dec. 30, 1999, entitled "BRUSH FOR REMOVING DUST".

SUMMARY OF THE INVENTION

The present invention is to mitigate and/or obviate the disadvantage of the conventional dusting brush.

The primary objective of the present invention is to provide a dusting brush that can be operated easily and conveniently, thereby facilitating the user operating the dusting brush.

Another objective of the present invention is to provide a dusting brush, wherein the bristles are fully hidden in the sliding sleeve when not in use, thereby enhancing the aesthetic quality of the dusting brush.

A further objective of the present invention is to provide a dusting brush, wherein the seat portion of the brush holder has a bottom formed with a flat face that can be placed on a horizontal face, such as the table, so that the dusting brush is disposed at an upright state without occupying the space.

In accordance with the present invention, there is provided a dusting brush, comprising a brush holder, a sliding sleeve slidably mounted on the brush holder, two symmetrical ornament shells mounted on the sliding sleeve to move therewith, and a plurality of bristles mounted on the brush holder, wherein:

the brush holder has a first end having an outer wall formed with two radially opposite locking bosses and a second end formed with an enlarged seat portion;

the sliding sleeve has an inner wall formed with two radially opposite slideways for slidably mounting the two locking bosses of the brush holder, each of the two slideways of the sliding sleeve has a bottom formed with a locking cavity for snapping and positioning a respective one of the two locking bosses of the brush holder;

the two ornament shells are combined with each other to surround the outer wall of the sliding sleeve; and the bristles are protruded outward from the first end of the brush holder.

Further benefits and advantages of the present invention will become apparent after a careful reading of the detailed description with appropriate reference to the accompanying drawings.

DETAILED DESCRIPTION OF THE INVENTION

Figure 1:
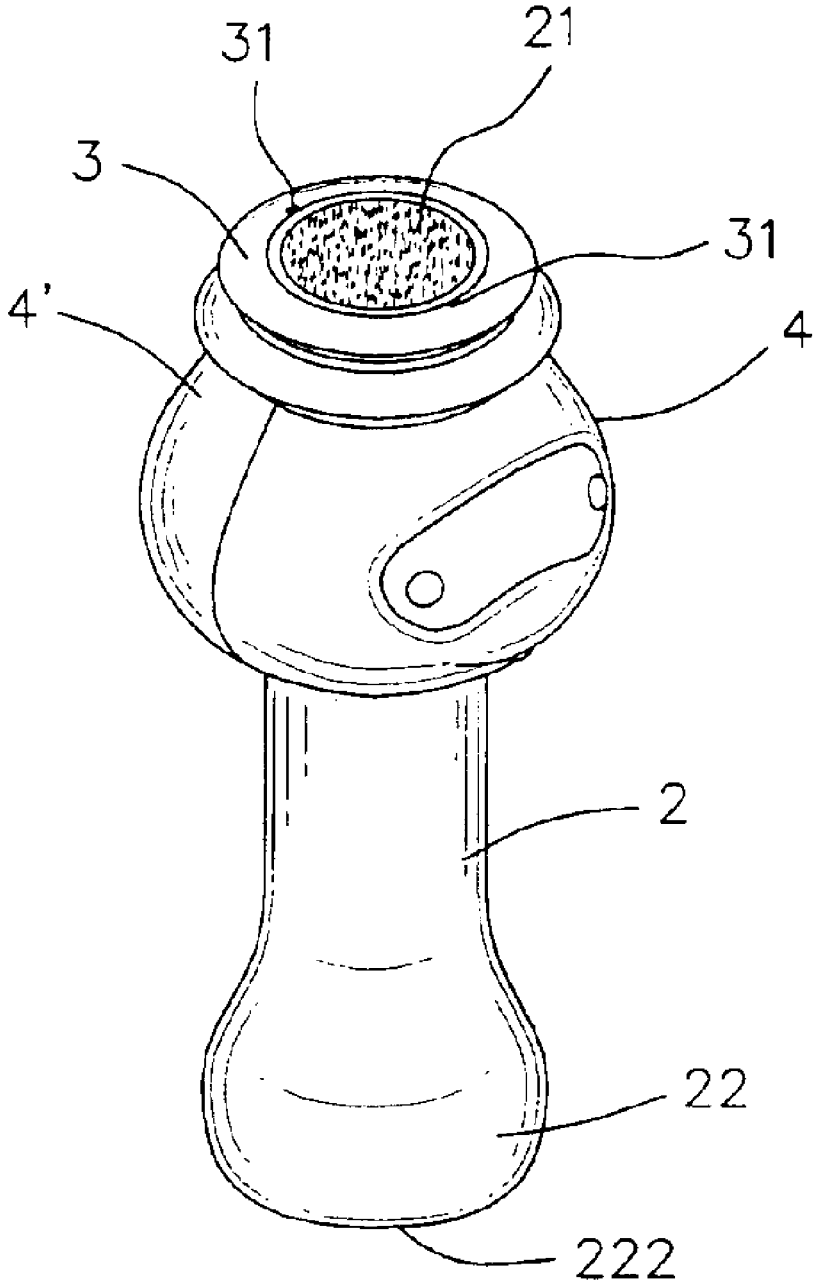
FIG. 1 is a perspective view of a dusting brush in accordance with the preferred embodiment of the present invention.
Figure 2:
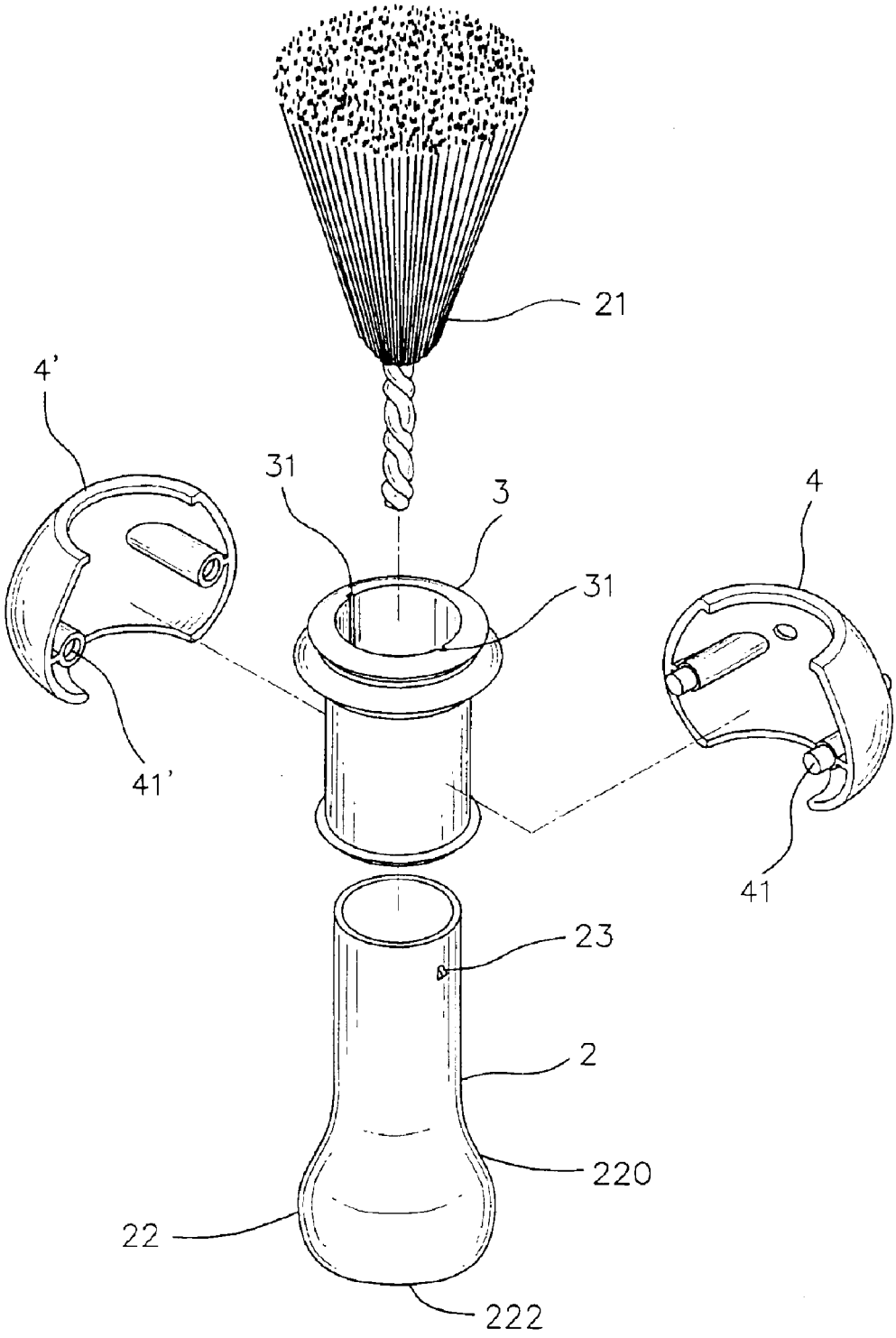
FIG. 2 is an exploded perspective view of the dusting brush 3 as shown in FIG. 1.
Figure 3:
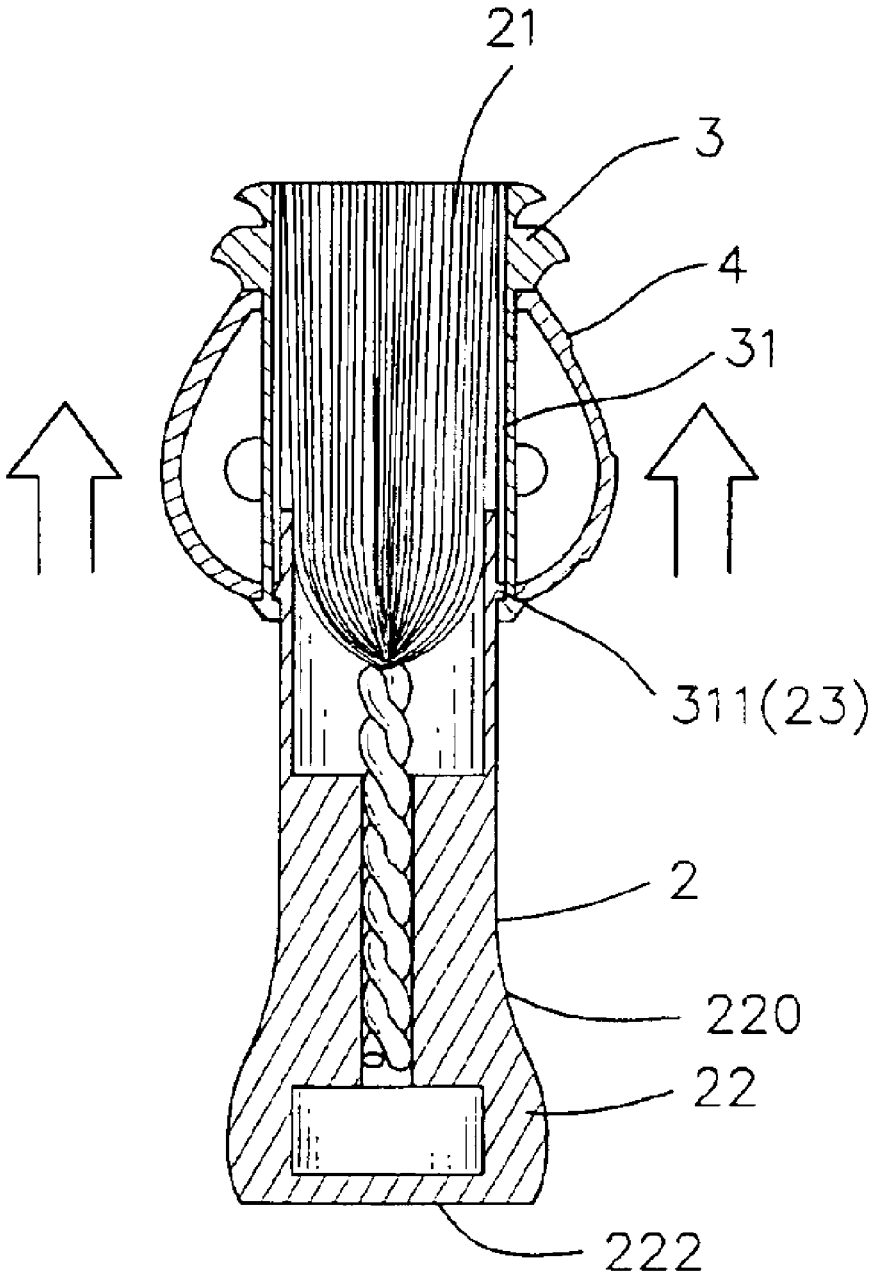
FIG. 3 is a plan cross-sectional view of the dusting brush as shown in FIG. 1.

Referring to the drawings and initially to FIGS. 1–3, a dusting brush in accordance with the preferred embodiment of the present invention comprises a brush holder 2, a sliding sleeve 3 slidably mounted on the brush holder 2, two symmetrical ornament shells 4 and 4' mounted on the sliding sleeve 3 to move therewith, and a plurality of bristles 21 mounted on the brush holder 2. The brush holder 2 has a first end having an outer wall formed with two radially opposite wedge-shaped locking bosses 23 and a second end formed with an enlarged seat portion 22. The seat portion 22 of the brush holder 2 is formed with a tapered urging face 220. In addition, the seat portion 22 of the brush holder 2 has a bottom formed with a flat face 222.

The sliding sleeve 3 has an inner wall formed with two radially opposite slideways 31 for slidably mounting the two locking bosses 23 of the brush holder 2. Each of the two slideways 31 of the sliding sleeve 3 has a bottom formed with a wedge-shaped locking cavity 311 for snapping and positioning a respective one of the two locking bosses 23 of the brush holder 2.

The two ornament shells 4 and 4' are combined with each other to surround the outer wall of the sliding sleeve 3. The ornament shell 4' is formed with two insertion holes 41' and the ornament shell 4 is formed with two insertion pins 41 each inserted into a respective one of the two insertion holes 41' of the ornament shell 4', so that the two ornament shells 4 and 4' are combined with each other.

The bristles 21 are protruded outward from the first end of the brush holder 2.

In operation, referring to FIGS. 1–5, the sliding sleeve 3 is slidable on the brush holder 2 to the position as shown in FIGS. 1 and 3, where each of the two locking bosses 23 of the brush holder 2 is snapped into and locked in the locking cavity 311 of a respective one of the two slideways 31 of the sliding sleeve 3, and the lower end of the sliding sleeve 3 is fixed on the first end of the brush holder 2, so that the bristles 21 are retracted into the sliding sleeve 3. Thus, the bristles 21 are filly hidden in the sliding sleeve 3 when not in use, thereby enhancing the aesthetic quality of the dusting brush.

Figure 4:
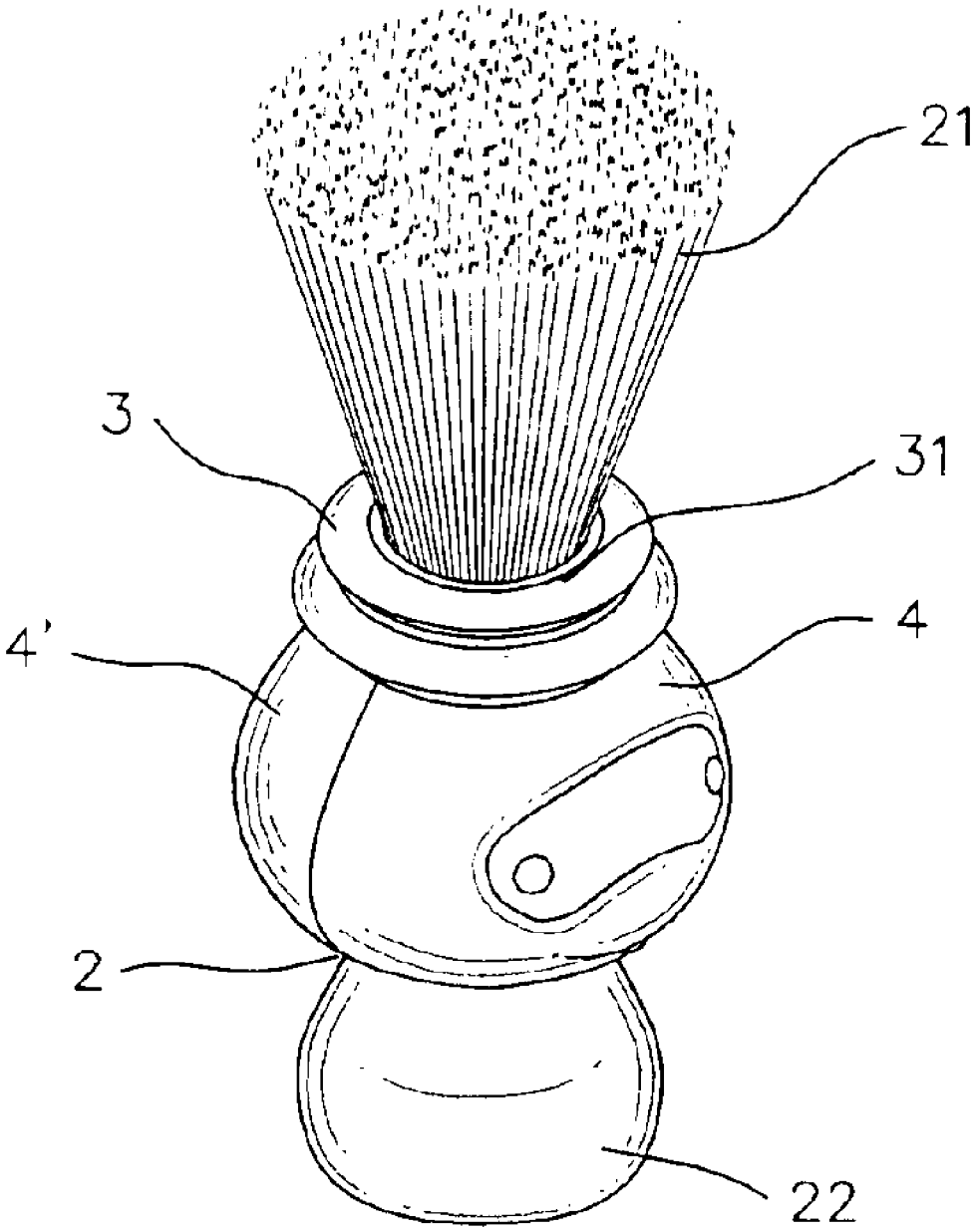
FIG. 4 is a schematic operational view of the dusting brush as shown in FIG. 1 in use.
Figure 5:
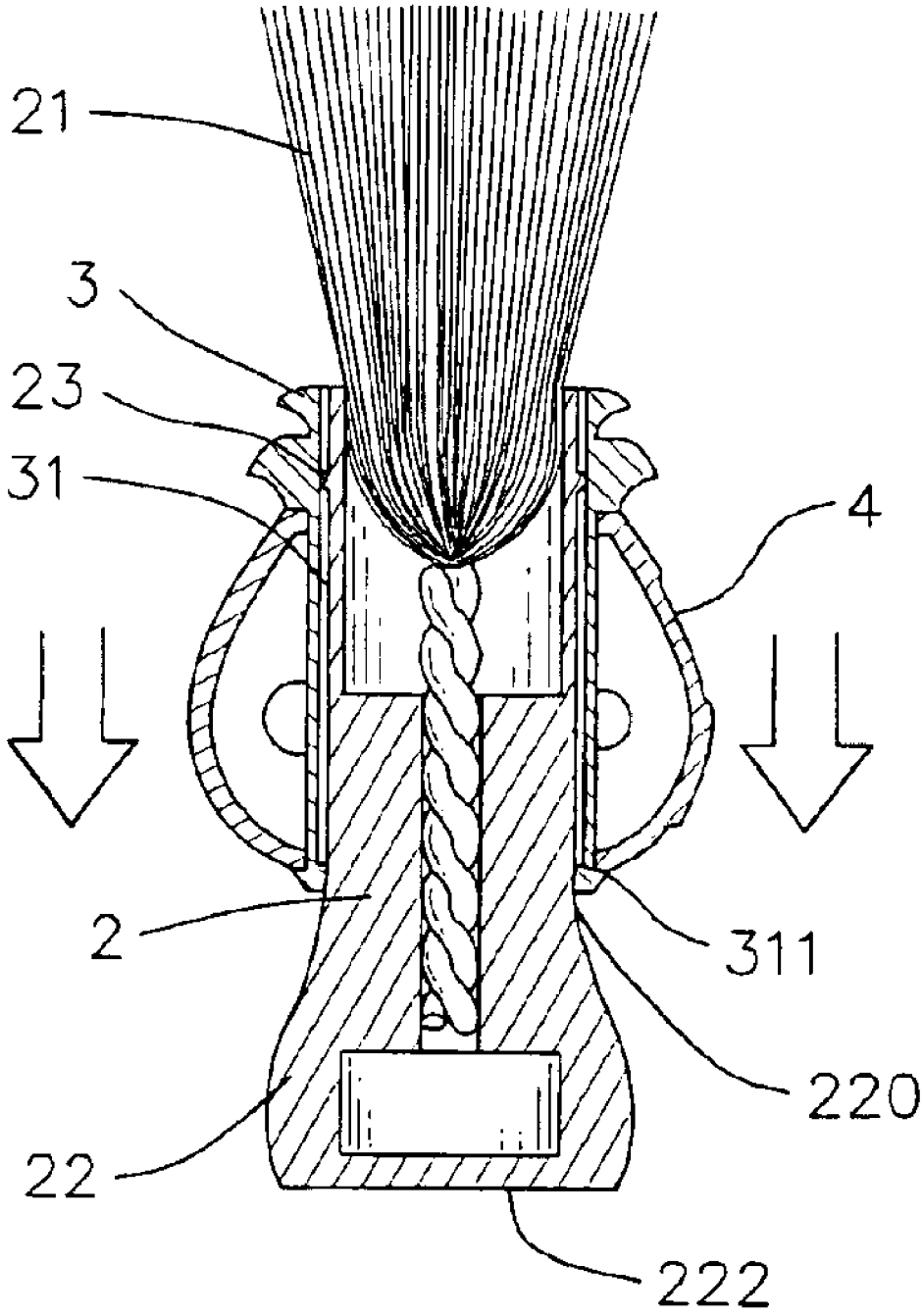
FIG. 5 is a schematic operational view of the dusting brush as shown in FIG. 3 in use.

Alternatively, the sliding sleeve 3 is slidable on the brush holder 2 to the position as shown in FIGS. 4 and 5, where each of the two locking bosses 23 of the brush holder 2 is detached from the respective locking cavity 311 of the sliding sleeve 3 and rested on the upper end of the sliding sleeve 3, and the lower end of the sliding sleeve 3 is urged on the urging face 220 of the seat portion 22 of the brush holder 2, so that the bristles 21 are protruded outward from the sliding sleeve 3 for use.

Accordingly, the dusting brush can be operated easily and conveniently, thereby facilitating the user operating the dusting brush. In addition, the bristles 21 are fully hidden in the sliding sleeve 3 when not in use, thereby enhancing the aesthetic quality of the dusting brush. Further, when the bristles 21 are protruded outward from the sliding sleeve 3 for use, each of the two locking bosses 23 of the brush holder 2 is rested on the upper end of the sliding sleeve 3, and the lower end of the sliding sleeve 3 is urged on the urging face 220 of the seat portion 22 of the brush holder 2, so that the sliding sleeve 3 is combined with the brush holder 2 rigidly and stably, thereby facilitating the user operating the dusting brush. Further, the seat portion 22 of the brush holder 2 has a bottom formed with a flat face 222 that can be placed on a horizontal face, such as the table, so that the dusting brush is disposed at an upright state without occupying the space. Further, the two ornament shells 4 and 4' are combined with each other to surround the outer wall of the sliding sleeve 3, thereby enhancing the aesthetic quality of the dusting brush.

Figure 6:
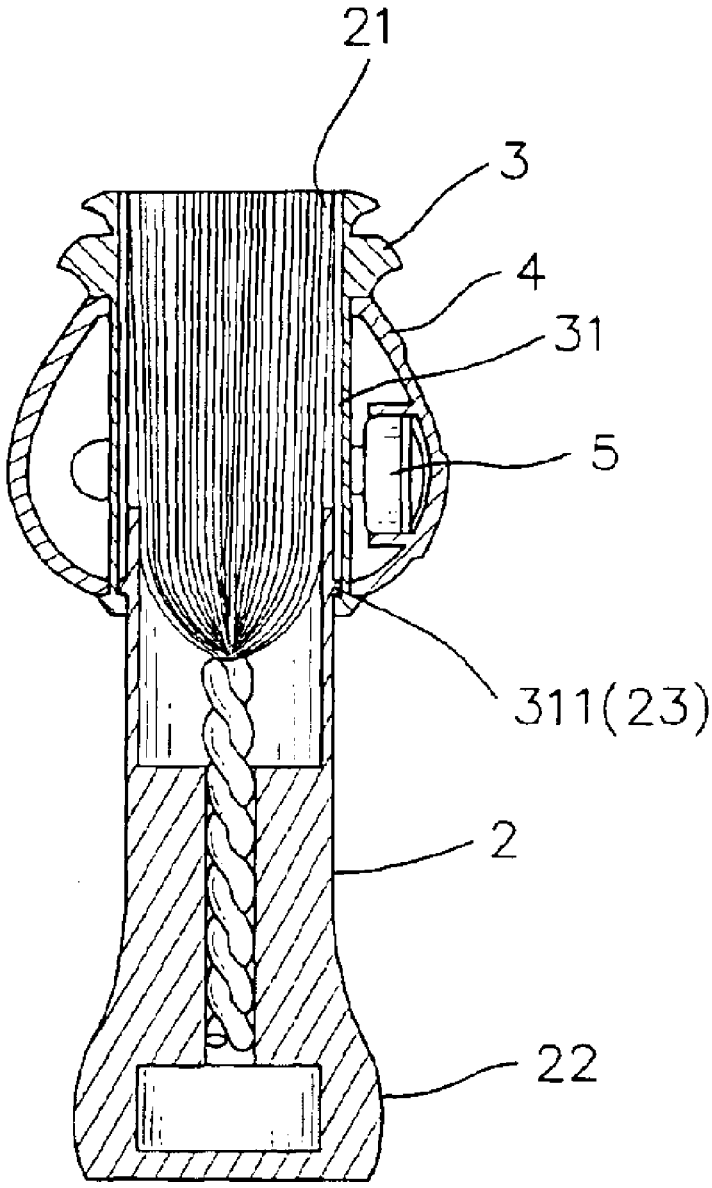
FIG. 6 is a plan cross-sectional view of a dusting brush in accordance with another embodiment of the present invention.

Referring to FIG. 6, the dusting brush in accordance with another embodiment of the present invention further comprises an incoming call display 5 mounted in the ornament shell 4.

Figure 7:
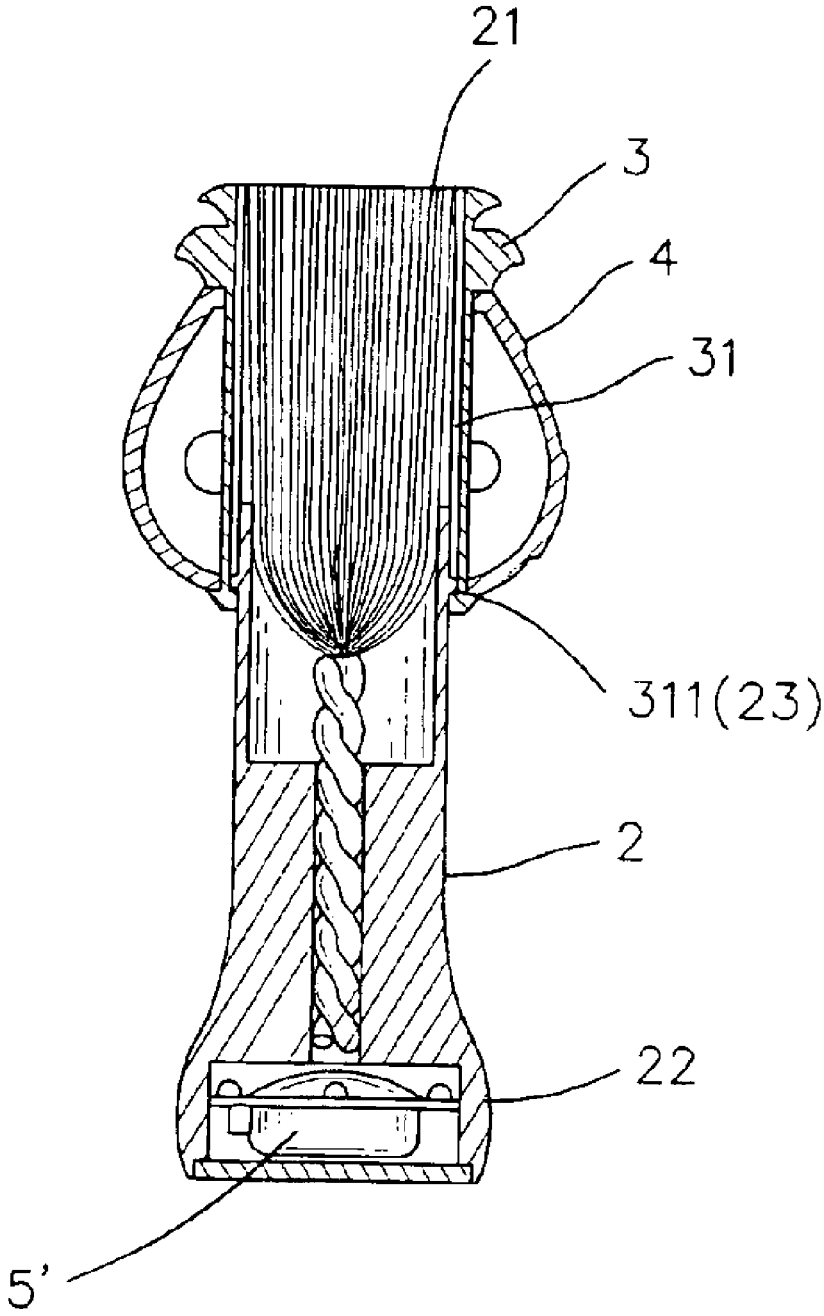
FIG. 7 is a plan cross-sectional view of a dusting brush in accordance with another embodiment of the present invention.
Figure 8:
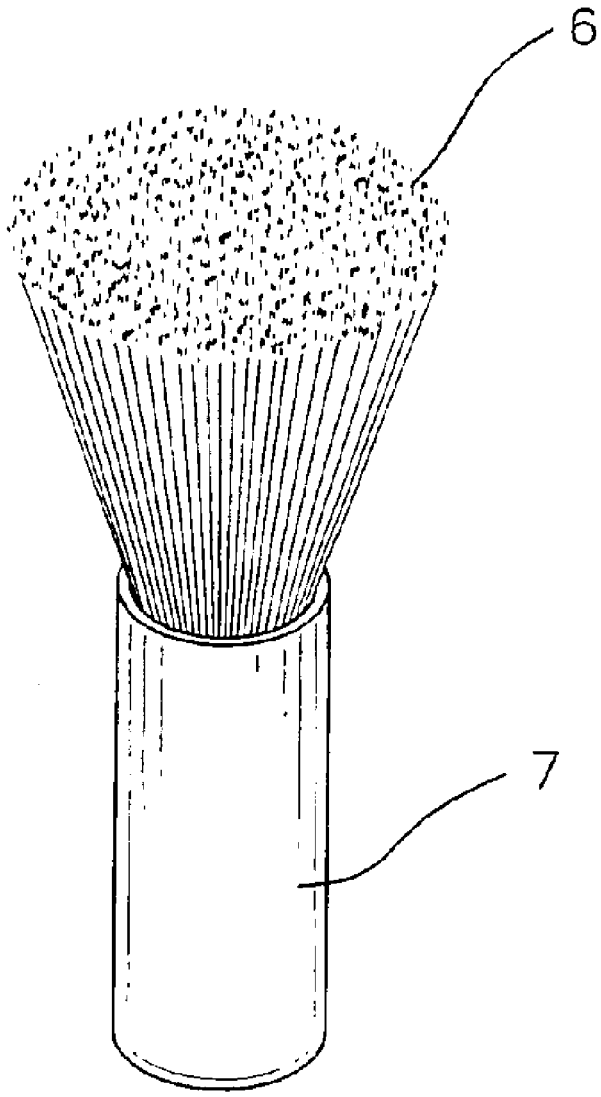
FIG.8 PRIOR ART
FIG. 8 is a perspective view of a conventional dusting brush in accordance with the prior art.

Referring to FIG. 7, the dusting brush in accordance with another embodiment of the present invention further comprises an incoming call display 5' mounted in the seat portion 22 of the brush holder 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A dusting brush, comprising a brush holder, a sliding sleeve slidably mounted on the brush holder, two symmetrical ornament shells mounted on the sliding sleeve to move therewith, and a plurality of bristles mounted on the brush holder, wherein:

the brush holder has a first end having an outer wall formed with two radially opposite locking bosses and a second end formed with an enlarged seat portion;

the sliding sleeve has an inner wall formed with two radially opposite slideways for slidably mounting the two locking bosses of the brush holder, each of the two slideways of the sliding sleeve has a bottom formed with a locking cavity for snapping and positioning a respective one of the two locking bosses of the brush holder;

the two ornament shells are combined with each other to surround the outer wall of the sliding sleeve; and the bristles are protruded outward from the first end of the brush holder.

2. The dusting brush in accordance with claim 1, wherein each of the two locking bosses of the brush holder is wedge-shaped.

3. The dusting brush in accordance with claim 1, wherein the seat portion of the brush holder has a bottom formed with a flat face.

4. The dusting brush in accordance with claim 1, wherein the locking cavity of each of the two slideways of the sliding sleeve is wedge-shaped.

5. The dusting brush in accordance with claim 1, wherein a first one of the two ornament shells is formed with two insertion holes and a second one of the two ornament shells is formed with two insertion pins each inserted into a respective one of the two insertion holes, so that the two ornament shells are combined with each other.

6. The dusting brush in accordance with claim 1, wherein the sliding sleeve is slidable on the brush holder to a position where each of the two locking bosses of the brush holder is snapped into and locked in the locking cavity of a respective one of the two slideways of the sliding sleeve, and a lower end of the sliding sleeve is fixed on the first end of the brush holder, so that the bristles are retracted into the sliding sleeve.

7. The dusting brush in accordance with claim 1, wherein the seat portion of the brush holder is formed with a tapered urging face, the sliding sleeve is slidable on the brush holder to a position where each of the two locking bosses of the brush holder is detached from the respective locking cavity of the sliding sleeve and rested on the upper end of the sliding sleeve, and a lower end of the sliding sleeve is urged on the urging face of the seat portion of the brush holder, so that the bristles are protruded outward from the sliding sleeve.

8. The dusting brush in accordance with claim 1, further comprising an incoming call display mounted in the ornament shell.

9. The dusting brush in accordance with claim 1, further comprising an incoming call display mounted in the seat portion of the brush holder.

* * * * *